United States Patent [19]

McQueen

[11] 4,327,626

[45] May 4, 1982

[54] SUBMACHINE GUN HAVING A PISTOL GRIP 360 DEGREES ROTATIVE ABOUT THE BARREL

[76] Inventor: Sidney J. McQueen, 414 Coors Blvd., SW., Albuquerque, N. Mex.

[21] Appl. No.: 182,096

[22] Filed: Aug. 28, 1980

[51] Int. Cl.[3] ..... F41D 7/08

[52] U.S. Cl. ..... 89/197; 42/72; 42/73; 89/132; 89/198

[58] Field of Search ..... 42/72, 73, 75 A, 75 B, 42/75 L; 89/132, 194, 196, 197, 199

[56] References Cited

U.S. PATENT DOCUMENTS

| | | | |
|---|---|---|---|
| 2,447,091 | 8/1948 | Pope | 89/197 |
| 3,651,736 | 3/1972 | Ingram | 89/199 |
| 3,970,398 | 7/1976 | Crouch | 42/73 |

FOREIGN PATENT DOCUMENTS

| | | | |
|---|---|---|---|
| 1153181 | 3/1958 | France | 89/196 |

*Primary Examiner*—Stephen C. Bentley
*Attorney, Agent, or Firm*—Walter R. Keller

[57] ABSTRACT

The submachine gun has a forward housing. The forward housing is installed over the forward bolt and barrel, and rotatably secured to the assembly collar, and to the barrel by a sling swivel and a muzzle nut. The forward housing has integrally made there with a pistol grip and trigger housing. The trigger housing contains the trigger mechanism and sear, said sear when the submachine gun is assembled engages selectively the plurality of ring grooves around the forward bolt. Externally attached and mounted to the front housing is a sight bridge. Thus assembled, the front housing with pistol grip and sight bridge may be fully rotated 360° with respect to the stock, magazine, and ejector port while the sear continously engages the ring grooves of the front bolt, and the weapon is ready to fire and fully operable at any point of the 360° rotation.

1 Claim, 2 Drawing Figures

SUBMACHINE GUN HAVING A PISTOL GRIP 360 DEGREES ROTATIVE ABOUT THE BARREL

SUMMARY

Submachine guns have long been used as a hand weapon by military, para-military and police forces. In the past submachine guns were usually chambered for standard military semi-automatic handgun ammunition, and the design parameters required that both hands of the firer be used to achieve operational proficiency. However, in prior art the orientation of the trigger and hand grip with respect to direction of cartridge ejection has been relatively fixed; thus limiting to a small number the safe, convenient positions in which the weapon can be proficiently fired and the person firing the weapon must of necessity use both hands and expose himself to enemy fire in order to fire at the enemy. It is therefore, an object of this invention to provide a weapon which is easily and accurately useable one or both hands and by left or right hand firers, and to provide a weapon which will allow the firer to fire at the enemy in a variety of the most advantageous positions as conditions and circumstances allow, without unnecessarily exposing himself. It is further an object of this invention to provide a weapon which is light weight, capable of rapid controllable and selective fire yet having a high degree of ruggedness and maintainability in the field, few moving parts, and an extended operating life.

BACKGROUND OF THE INVENTION

1. Field of the Invention

This invention relates generally to automatic and semi-automatic hand weapons and more particularly to submachine guns.

2. Description of Prior Art

The most well known submachine guns are the Thompson, UZI and Ingram. It is a design characteristic of these weapons that the firer use both hands to control the weapon. In each instance the design provides a pistol grip for the trigger finger and a forearm grip or straps for the second hand to hold on to in order to secure and steady the weapon. Cartridge case ejection on these weapons is approximately 45° clockwise from the vertical as viewed by a right handed firer. Consequently, a left handed firer frequently finds himself hit on the upper torso and in the face with one or more hot cartridge cases which are being ejected from left to right across and in front of the upper body and in lose proximity thereto. There have been other weapons which have provided only limited rotation of the grip with respect to cartridge ejection; however, none are known to provide the 360° rotation of the present invention nor as a result to provide such a high degree of adaptability to an individual firer's personal preferences and physical requirements nor to lend itself so well to assurate fire control and combat situation flexibility.

DESCRIPTION OF PREFERED EMBODIMENT

Figure 1:
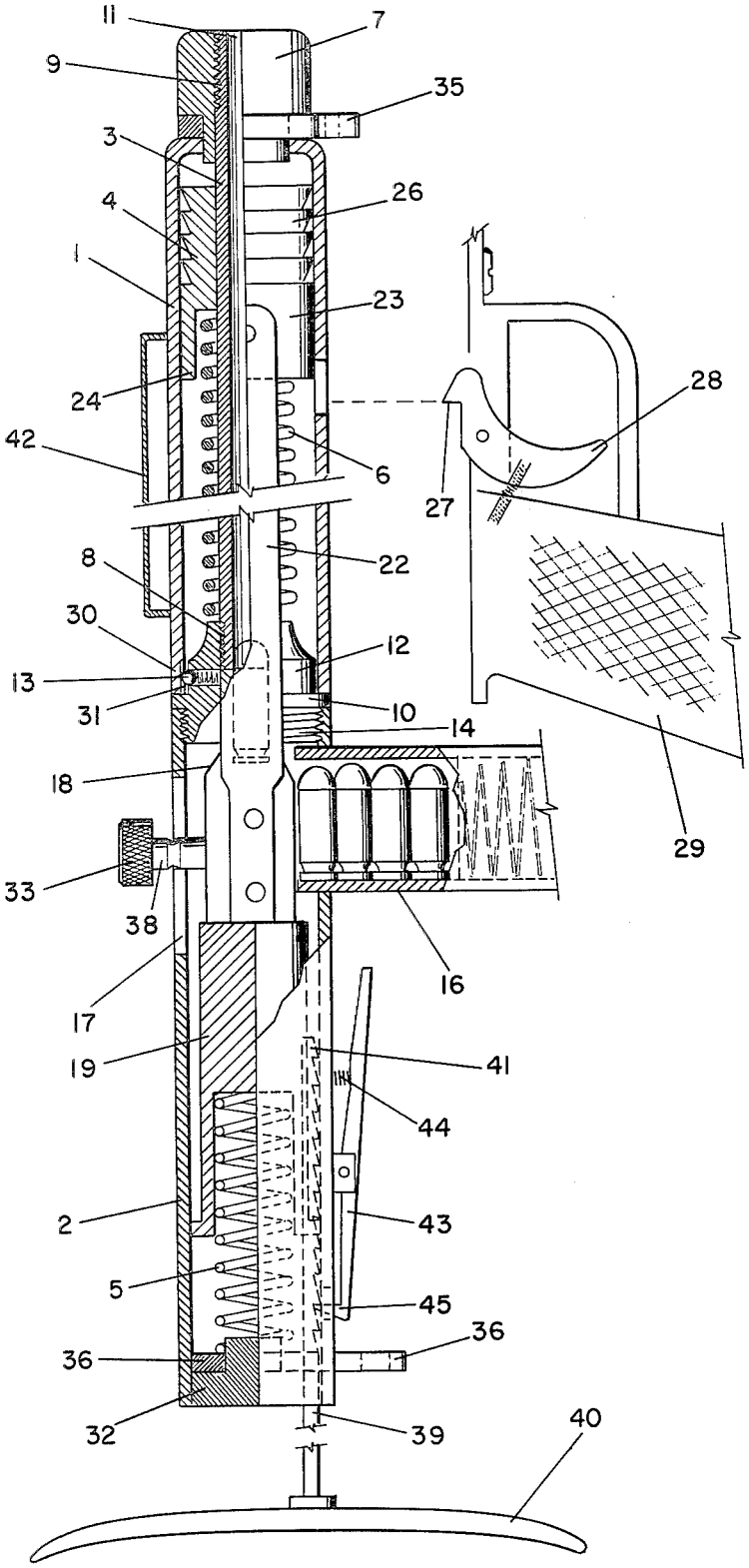
FIG. 1 is a cut away side view of the invention.
Figure 2:
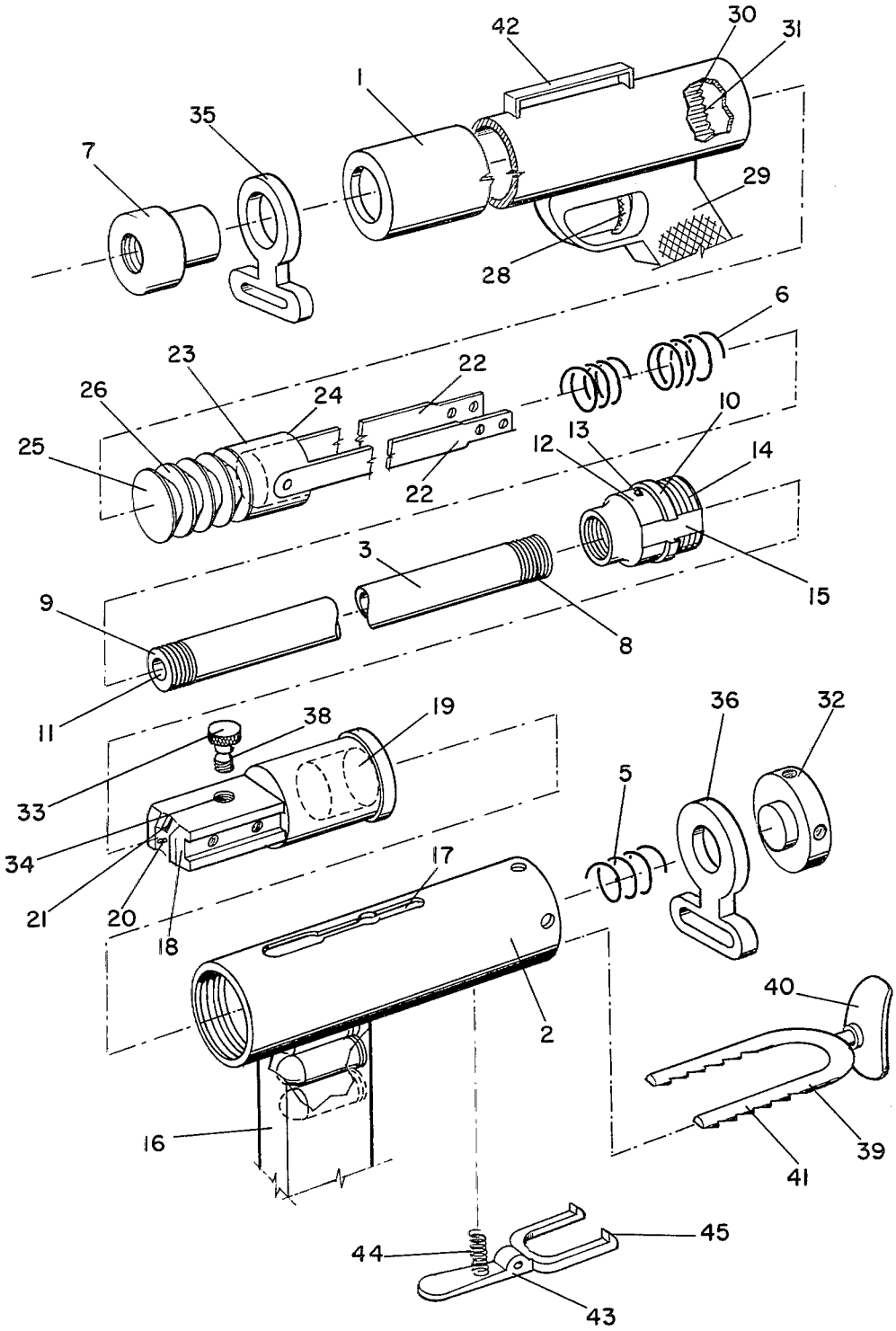
FIG. 2 is an exploded isometric of the invention.

FIG. 1 shows the invention to consist of a front housing 1, a rear housing 2, a barrel 3, a bolt body 4, a recoil buffer spring assembly 5, a bolt spring 6, and a muzzle nut 7. The barrel 3 has a chamber end 8 and a muzzle end 9. The barrel 3, of the desired caliber, has a center bore 11 with a standard rifling. The muzzle end 9 of the barrel 3 has threads on its exterior to mate with the muzzle nut 7. The chamber end 8 of the barrel 3 has threads on its exterior to mate with an assembly collar 10. The assembly collar 10 has a center bore which is threaded to mate with the chamber end 8 of the barrel 3. The assembly collar 10 has a shoulder 12 in which there are plurality of spring loaded balls 13 evenly spaced around the circumference of the shoulder 12. The assembly collar 10 also has a ring flange 14 around its exterior to which the rear housing 2 is rigidly affixed as by threads or taps and screws, or weldment. The assembly collar 10 has two slots 15, one on each side. The rear housing 2 contains a standard magazine housing 16, and has a slot 17 on the top for manual bolt movement and cocking, safety features, and cartridge ejection. The assembly collar 10 also has a conical chamfer 18 adjacent to the chamber end 8 of the barrel 3 to guide ammunition into the chamber end 8 of the barrel 3. The bolt body 4 consists of a rear bolt 19, a forward bolt 23 and two side rails 22. The rear bolt 19 contains a firing pin 20 and extractor mechanism 21, of standard and known design. Rigidly affixed to each of the sides of the rear bolt 19 by taps and screws, or pins, are side rails 22. The side rails 22 pass through the slots 15 extending forward along each side of the assembly collar 10. The forward ends of the side rail 22 are rigidly affixed to the sides of the forward bolt 23. The bolt spring 6, a coil spring, is installed around the barrel 3 between the assembly collar 10 and the forward bolt 23. The forward bolt 23 is generally cylindrical in shape having a center bore sized to slideably accept the barrel 3 within. The forward bolt 23 has a spring end 24 and a front end 25. The spring end 24 is recessed to accept the bolt spring 6, and the front end 25 has a plurality of ring grooves 26, each of which mateably engage a sear 27. The front housing 1, contains a trigger mechanism 28, the sear 27, and a pistol grip 29. At its rear the front housing 1 has a shoulder 30 in which a plurality of detents 31 are circumferentially placed, thus allowing the front housing 1 to rotate on the assembly collar 10 and the detents 31 to engage the spring loaded balls 13. The muzzle end of the front housing 1 is sized to rotatably slide over the barrel 3 and rotatably mate with the muzzle nut 7. A sight bridge 42 is mounted on the exterior of the front housing 1 diametrically opposite the pistol grip 29. The sight bridge 42 is formed to accommodate a variety of sights. To complete assembly a front sling swivel 35 is slid over the barrel and the muzzle nut 7 is treaded on the muzzle end 9 of the barrel 3 to secure the front housing 1; and the recoil buffer spring assembly of standard and known construction is inserted in the rear end of rear housing 2 and secured by a butt plug 32 threaded or pinned into the rear end of the rear housing 2. Rotatably slid onto the butt plug is a rear plug swivel 36 of known construction. The front sling swivel 37 is generally donut shaped having a protruding loop through which a sling may be attached. To facilitate manual positioning of the bolt body 4 a knurled bolt knob 33 is screwed or locked by detent into a tap 34 in the top of the rear bolt 19. The knurled knob 33 passes through the slot 17 and slides in said slot 17 as the rear bolt 19 moves forward and aft. The slot 17 has at its foward end a cartridge ejection port, and along the length of said slot are a plurality of enlargements. The kurled knob 33 has a stem 38 which consists of two shafts, one hollow with locking internal detents and the other having position ears, which mateably engage such that the knurled knob 33 may be raised or lowered with respect to the slot 17, and the stem 38 having adjacent to the knurled knob 33 a larger diameter sized to fit the enlargements in slot 17, thus providing safety positions for the rear bolt 19. The rear housing 2 has channels internally one on each side running lengthwise from the butt end toward the assembly collar 10. An adjustable stock 39 generally having a body pad 40, pivotally mounted to two extension arms 41, is slideably mated into the channels in the rear housing 2. The body pad 40 is a curved member shaped to mate comfortably with parts of the firers body such as the inner elbow or the shoulder. The extension arms 41 are each long and rod like having notches which mateably engage a stock latch 43, thus providing a sliding adjustable stock to the weapon. Pivotally mounted on the bottom of the rear housing 2 is the stock latch 43. The stock latch 43 has two latch hooks 45, and each latch hook 45 engages the notches in an extension arm 41. The stock latch 43 is biased in the latched mode by a latch spring 44 between the rear housing 2 and the stock latch 43. The latch spring 44 is illustratively shown as a coil spring, but may be any of a multitude of standard and known biasing means such as a flat spring member.

Thus, completely assembled the foward housing 1 is fully rotatable with respect to the barrel 3 and rear housing 2. The cartridge ejection provided in the rear housing 2 is thus fully rotational three hundred sixty degree with respect to the pistol grip 29. By making the forward bolt 23 cylindrical over the barrel 3, and the rear bolt 19 being generally aligned axially with the barrel 3, the inertia during firing of the bolt body 4 is nearly perfectly aligned with the axis of the weapon. Consequently, the recoil of the weapon does not tend to pull the weapon off the target, and the firer is able to maintain excellent control and to score more accurate hits on the target with either one handed or two handed operation. The distribution of the mass of the bolt body 4 toward the muzzle and toward rear of the weapon tends to minimize the bucking associated with automatic hand held weapon further complementing the weapons accuracy. The location of the pistol grip 29 and trigger mechanism 28 toward the forward end of the weapon provides good balance, and with the stock 39 adjusted to fit near a firers bicep and elbow joint, the weapon becomes more nearly an extension of the forearm of the firer, providing the firer with a comfortable, adaptable, flexible firing platform.

I claim:

1. A submachine gun comprising a barrel, a forward housing, a rear housing, a bolt body, an assembly collar, a forward assembly nut, a butt plug, a recoil buffer spring and a bolt spring wherein;

the barrel is threaded into the assembly collar, and the assembly collar has shoulder wih a plurality of spring balls, which rotatably engages the forward housing, and;

the assembly collar having a chamber for receiving and guiding ammunition and slots on each side through which side rails slide, and the rear housing having a slot in its top and having a magazine housing and;

the bolt body comprising a rear bolt, a forward bolt, and two side rails wherein the two side rails are rigidly affixed one on each side to the forward bolt and the rear bolt and;

the rear bolt containing a firing pin and extractor mechanism and being slideably inserted in the rear housing, and having a tap on its top, and;

the assembly collar having a ring flange to which the rear housing is rigidly affixed, and the assembly collar having slots on each side, and the two side rails being rigidly affixed one on each side of the rear bolt, said rails protruding forward past the slots on the assembly collar, and said side rails being rigidly affixed to the forward bolt, and;

the forward bolt having in its rear a spring recess to engage the bolt spring, and said forward bolt having in its forward end a multiplicity of ring grooves, and;

the bolt spring slideably installed over the barrel and between the assembly collar and the forward bolt, and;

the forward housing having a shoulder at its rear end, said shoulder having detents to accept the spring balls in the assembly collar, said shoulder in the forward housing being rotatably mated with the shoulder on the assembly collar, and the front of the forward housing being rotatably sized to slide over the barrel, a sling swivel rotatably slid over the muzzle nut, and the muzzle nut threaded onto the muzzle end of the barrel to secure the forward housing rotatably in place, the forward housing having the trigger mechanism, pistol grip and sear, said sear mateably engaging the multiple ring grooves on the forward bolt, and;

a knurled bolt knob which is inserted through the slots in the top of the rear housing and affixed to the top of the rear bolt, and;

the recoil spring assembly is installed in the rear of the rear housing and secured therein by a butt plug threaded or pinned into the rear housing, said butt plug having a rear sling swivel rotatably mounted thereon, and;

a sight bridge rigidly affixed to the front housing, and;

an adjustable stock having generally a body pad rotatably mounted on two extension arms each of which has notches, said extension arms slideably mating with channels in the rear housing and;

a stock latch pivotally mounted on the bottom of the rear housing, said stock latch having two latch hooks each hook engaging notches on one of the extension arms, and said stock latch being biased in the latched position by a latch spring.

* * * * *